US011116307B2

(12) United States Patent
Coppee

(10) Patent No.: US 11,116,307 B2
(45) Date of Patent: Sep. 14, 2021

(54) MODULAR HAIR BRUSH DISPENSING STYLING PRODUCTS

(71) Applicant: Rose Coppee, Queens Village, NY (US)

(72) Inventor: Rose Coppee, Queens Village, NY (US)

(73) Assignee: Rose Coppee, Queens Village, NY (US)

( * ) Notice: Subject to any disclaimer, the term of this patent is extended or adjusted under 35 U.S.C. 154(b) by 0 days.

(21) Appl. No.: 16/220,967

(22) Filed: Dec. 14, 2018

(65) Prior Publication Data

US 2019/0183238 A1 Jun. 20, 2019

Related U.S. Application Data

(60) Provisional application No. 62/708,607, filed on Dec. 15, 2017.

(51) Int. Cl.
*A46B 11/00* (2006.01)
*A46B 5/00* (2006.01)

(52) U.S. Cl.
CPC ..... *A46B 11/0037* (2013.01); *A46B 5/0095* (2013.01); *A46B 11/0062* (2013.01); *A46B 11/0065* (2013.01); *A46B 2200/104* (2013.01)

(58) Field of Classification Search
CPC ... A46B 11/0037; A46B 11/00; A46B 11/001; A46B 11/002; A46B 11/0024; A46B 11/0027; A46B 11/0055; A46B 11/0062; A46B 11/0065; A46B 11/0072; A46B 5/0095
USPC ..... 401/268, 270, 272, 275, 277, 282, 283, 401/290, 176, 179, 172, 174
See application file for complete search history.

(56) References Cited

U.S. PATENT DOCUMENTS 1,783,754 A * 12/1930 Stepelton ..... A46B 11/0027 401/175
2,145,570 A * 1/1939 Miettunen ..... A46B 11/002 401/176
6,022,163 A * 2/2000 Asfur ..... A45D 24/22 132/112
7,004,662 B1 * 2/2006 Gordon ..... A46B 11/0017 401/180
7,243,660 B2 * 7/2007 Capristo ..... A45D 19/02 132/112

(Continued)

*Primary Examiner* — David J Walczak
(74) *Attorney, Agent, or Firm* — Jones Day

(57) ABSTRACT

A modular hair brush for dispersing styling products, therapeutic, and medicated treatments from a product holder in a brush handle. The head portion of the brush includes bristles that are positioned near openings that disperse the treatment product(s) stored within the handle. When product application is desired, a manual push or twist mechanism is engaged, which causes one or more products to pass through the openings to the bristles of the brush and onto the hair during normal combing. Different examples provide for the use of replaceable brush heads that can be adjusted to different hair texture and thickness, or type of hair styling. A replaceable product insert can use different viscous liquid solutions designed for different treatment. The modular brush allows for mixing of different hair products before application, offering a portable, refillable, on-the-go multifunctional beauty tool.

5 Claims, 8 Drawing Sheets

(56) References Cited

U.S. PATENT DOCUMENTS 7,481,228 B2 * 1/2009 Ragosta ..... A45D 1/04
132/238
8,534,950 B2 * 9/2013 Sylvester ..... A46B 11/0024
401/172

* cited by examiner

Close-Up of Brush Head

MODULAR HAIR BRUSH DISPENSING STYLING PRODUCTS

I. CROSS-REFERENCE TO RELATED APPLICATIONS

This application claims priority from provisional U.S. application Ser. No. 62/708,607 filed on Dec. 15, 2017, the entirety of which is hereby incorporated by reference for all purposes.

II. STATEMENT REGARDING FEDERALLY SPONSORED RESEARCH OR DEVELOPMENT

Not applicable.

III. REFERENCE TO A COMPACT DISK APPENDIX

Not applicable.

IV. BACKGROUND OF THE INVENTION

A. Field of the Invention

This invention relates to a hair brush assembly for the treatment of hair such as hair styling, coloring, bleaching or perming treatment, and in particular to a modular hair brush for dispensing styling or therapeutic products.

B. Description of Related Art

Consumers wishing to style and groom their hair may go to a professional salon or use a commercially available retail product at home. Professional salons deliver desirable treatment outcomes but procedures there are expensive, especially over time for consumers who regularly use treatment. Applying commercially available retail products in private, the other hand, is not simple: it could be messy, inconvenient and is not guaranteed to deliver consistent results. For example, properly applying different types of gel, mousse, cream, spray or other treatment product to enhance or change the texture of the entire hair may be difficult, at least because of problems reaching specified areas of the head, or applying the wrong amount of product. Currently, whether in a professional salon or at home, proper application is difficult and time consuming as it often involves the use of a toothbrush or similarly small applicator dipped in a desired product. That product would then have to be transferred to the hair in a controlled manner, which is messy and problematic. In short, there is a well-known problem transferring grooming products to the hair. Some solutions include, for example, a container filled with a liquid styling agent that is dispersed through a spray nozzle in a brush, driven by a trigger. While having the convenience of a product and brush integrated it leaves the problem of overspray and limits the product use to liquids. Another problem is the use of pressurized product containers, which may be hazardous to transport, especially on a plane, and cumbersome to fit within a standard hair brush. Other known solutions are likewise bulky, leaky when operated, visually unappealing and cumbersome to use.

Therefore, there is a need to provide a simple retail kit for hair treatment which offers the user better control over the amount of product distributed to different parts of the hair, and may be compatible with different types of hair.

V. SUMMARY OF THE INVENTION

According to an example, provided is a modular hair brush assembly for dispensing hair treatment product when combing hair, the modular hair brush assembly comprising: an elongated handle to be gripped by a hand, the handle having a longitudinal axis and axially opposed first and second ends, at least the first end having an opening, the handle further having an interior hollow chamber in fluid communication with the opening at the first end of the handle, the chamber being configured to receive one or more viscous liquid hair treatment products; at least one replaceable brush head comprising a brush surface, a plurality of bristles projecting from the brush surface, and a plurality of openings formed on the brush surface between or partially coextensive with at least some of the plurality of bristles, the brush head being removably connected to the first end of the handle, wherein the plurality of openings are in fluid communication with the hollow chamber of the handle through the opening at the first end of the handle; and a extruder assembly configured to move one or more viscous liquid hair treatment products from within the chamber through the plurality of openings on the brush surface onto the plurality of bristles of the brush head.

In another example is provided a modular hair brush assembly further comprising a replaceable product insert configured to fit within the chamber of the handle and comprising one or more viscous liquid hair treatment products. The modular hair brush assembly may further comprise at least two replaceable brush heads having projecting plurality of bristles of different density. The modular hair brush assembly may further comprise at least two replaceable brush heads having projecting plurality of openings with different size, allowing the use of hair treatment products having different viscosity.

In yet another example, a modular hair brush assembly is provided, wherein the plurality of bristles is arranged in bunches of micro bristles forming an array of rows and columns of bristle bunches.

Additional examples include a modular hair brush assembly, wherein the at least one replaceable brush head comprises a connector providing substantially leak-free connection to the first end of the handle. The replaceable brush head in this example may be a threaded Luer connector.

In another example, the modular hair brush assembly, may have a handle made of engineering plastic as an integral component. In another example of a modular hair brush assembly, the second end of the handle has an opening, the assembly further comprising a base with a threaded connection to the second end of the handle moving axially with respect to the handle, a piston moving axially within the chamber to force hair treatment product out from the first opening of the handle, and a piston rod attached to the base for axially moving the piston when the base is twisted.

In another example, a liquid dispensing hair brush is provided comprising: an elongated body having a longitudinal axis, a first and second end along the axis and a chamber; a product container carried within said chamber, the container configured to store one or more viscous liquid hair treatment products; a brush head having plurality of bristles projecting from the head, and a plurality of openings alongside said plurality of bristles, the plurality of openings being in fluid communication with the container storing the one or more hair treatment products to dispense the one or more products onto the plurality of bristles; the brush head operatively connected to the first end of the elongated body;

and an extruder configured to push hair treatment products from the product container to the plurality of openings of the brush head.

In another example of the liquid dispensing hair brush, the extruder comprises a twist on base attached to the second end of the elongated body and a piston within said chamber, the piston moving along the axis in a direction from the second end to the first end of the body when the base is twisted in one direction, the motion of the piston extruding the one or more products from the chamber onto the plurality of bristles. Further, in the same example the piston moves along the axis in a direction from the first end to the second end of the body when the base is twisted in the opposite direction to provide space within the chamber for supplying one or more hair treatment products.

In another example of the liquid dispensing hair brush, the extruder comprises a slider carried axially by said body, said slider protruding through said body for operation by a user, and causing a piston within said chamber to move along the axis in a direction from the second end to the first end of the body when the slider is pushed toward the first end of the body, the motion of the piston extruding the one or more products from the chamber onto the plurality of bristles. As a further example, moving the slider in a direction from the first end to the second end of the body causes the piston to move along the axis in the same direction to provide space within the chamber for supplying one or more hair treatment products.

In another example of the liquid dispensing hair brush the elongated body is attached to the brush head using threaded connection providing leak-free conduit for the one or more hair treatment products within the container to the plurality of the openings on the brush head.

In another example of the liquid dispensing hair brush the plurality of bristles are arranged in an array of micro bristle bunches, and the plurality of openings are arranged at regular intervals between the micro bristle bunches.

Additional examples of the liquid dispensing hair brush include cases where the product container is replaceable or refillable.

In another example, a method of using a liquid dispensing hair brush is provided, comprising the step of: providing a carrier with a hair treatment product; loading the provided carrier in a chamber of a hair brush handle; forcing hair treatment product out from the carrier into a conduit providing liquid connection to openings located between bristles of the hair brush, the step of forcing being done by manual operation of a extruder mechanism in the handle; and combing hair of a customer to transfer hair treatment product from the bristles of the hair brush to the hair.

VI. BRIEF DESCRIPTION OF THE SEVERAL VIEWS OF THE DRAWINGS

The foregoing summary, as well as the following detailed description, will be better understood when read in conjunction with the appended drawings. For the purpose of illustration, certain embodiments of the present disclosure are shown in the drawings. It should be understood, however, that the invention is not limited to the precise arrangements, dimensions and instrumentalities shown. The accompanying drawings, which are incorporated in and constitute a part of this specification, illustrate an implementation of system, apparatuses, and methods consistent with the present invention and, together with the description, serve to explain advantages and principles consistent with the invention.

FIG. 1A, FIG. 1B, FIG. 1C, FIG. 1D is a perspective view of an assembled example of a modular hair brush (FIG. 1A), with close-up views of an example of removable brush head in different views (FIG. 1B, FIG. 1C, FIG. 1D);

FIG. 2A, FIG. 2B, FIG. 2C, FIG. 2D include a perspective view of a disassembled example of a modular hair brush (FIG. 2A), with close-up views of an example of the brush handle and product holder in different views (FIG. 2B, FIG. 2C, FIG. 2D);

VII. DETAILED DESCRIPTION OF THE INVENTION

Figure 1A:
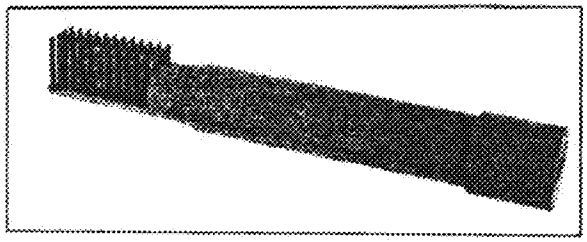

Before explaining at least one embodiment of the invention in detail, it is to be understood that the invention is not limited in its application to the details of construction and to the arrangements and dimensions of the components set forth in the following description or illustrated in the drawings. The Figures and written description are provided to teach any person skilled in the art to make and use the inventions for which patent protection is sought. The invention is capable of other embodiments and of being practiced and carried out in various ways. Those skilled in the art will appreciate that not all features of a commercial embodiment are shown for the sake of clarity and understanding. Persons of skill in the art will also appreciate that the development of an actual commercial embodiments incorporating aspects of the present inventions will require numerous implementation specific decisions to achieve the inventor's ultimate goal for the commercial embodiment. While these efforts can be time-consuming, these efforts nevertheless would be a routine undertaking for those of skill in the art having the benefit of this disclosure.

In addition, it is to be understood that the phraseology and terminology employed herein are for the purpose of description and should not be regarded as limiting. For example, the use of a singular term, such as, "a" is not intended as limiting of the number of items. Also the use of relational terms, such as but not limited to, "top," "bottom," "left," "right," "upper," "lower," "down," "head", "tail", "up," "side," and "surface" are used in the description for clarity in specific reference to the Figures and are not intended to limit the scope of the invention or the appended claims. Further, it should be understood that any one of the features of the invention can be used separately or in combination with other features. Other systems, methods, features, and advantages of the invention will be or become apparent to one with skill in the art upon examination of the Figures and the detailed description. It is intended that all such additional systems, methods, features, and advantages be included within this description, be within the scope of the present invention, and be protected by the accompanying claims. For consistency and the reader's ease, in the disclosure similar items have been designated with the same reference numerals.

As used herein the term "hair" to be treated may be "living" i.e. on a living body or may be "non-living" i.e. in a wig, hairpiece or other aggregation of non-living keratinous fibers. By "hair treatment" composition it is meant a composition suitable for accomplishing a desired effect, such as styling the hair, changing the color of hair, or applying a treatment including a gel, mousse, pomade or cream. Collectively, these hair treatment products will be designated herein as a "hair product" or simply "product", with the understanding that dependent on the particular application the product may have different composition. For example, a hair coloring composition can comprise oxidative dye precursors, direct dyes or even no, or substantially no, dyes in case of bleaching only compositions where the change of color is mainly caused by the degradation of the natural melanin contained in the hair shaft by the oxidizing agent. Likewise, conventional hair styling or edge control compositions may be used in different embodiments in a form described below for easy application and transfer to the hair.

In some embodiments according to the present invention, the hair treatment products may be applied to hair which has already been previously treated. In such a case, the terms "root", "hair roots", "root hair line" and "virgin hair" all refer to the portion of hair having grown, since the last treatment, said portion of hair being virgin, i.e. natural. The terms "hair lengths and tips" refer to the remaining portion of hair having been already previously treated. The hair "edge" is the natural edge of the hair, which may be subject to special treatment as it is frequently the most damaged or most difficult to treat portion of the hair.

Reference will now be made in detail to an implementation consistent with the present invention as illustrated in the accompanying drawings. For the purpose of clarification, embodiments described herein reference the term "fluid," which refers to a liquid, as well as liquid solution with solid aggregates, as well as any other material that can reasonably be expected to flow. As described below, hair products used in accordance with the invention are fluid compositions that have certain viscosity allowing them to flow under normal conditions, such as 70 degree F. and at atmospheric pressure (760 mmHg). For purposes of illustration they may have the viscosity of a commercial hair styling gel, such as Edge Booster.

A. The Brush Head

Referring to FIGS. 1A-1D, by way of non-limiting example, and consistent with embodiments of the invention, FIG. 1A is a perspective view of an assembled modular hair brush in one example. As further described below and also illustrated in FIGS. 2A, 3A-3E and 4A-4E, this example of a modular hair brush has four main components, including a removable brush head 100, a handle 200, a product carrier or insert 300, and an base 400, which in this example is also used to move the product from the insert to the brush head.

Figure 1B:
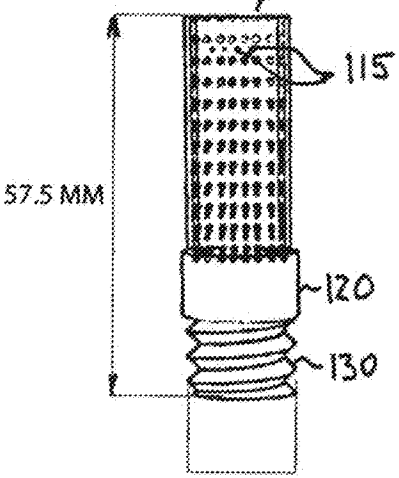

FIG. 1B is a top view of the removable brush head, which in this particular example is dimensioned at 57.5 mm×14.5 mm. As shown in this figure, and further illustrated in the side views in FIGS. 1C and 1D, the brush head is comprised of a bed of bristles 110, a neck portion 120 and a connector 130 for connecting the brush head to the brush handle. It is important to note that in one aspect the present invention provides for a hair care kit that includes detachable and replaceable brush heads and product inserts that can be used for different purposes. For example, it is well known that different customers have hair with different texture, density, softness and thickness, and in general it may be advantageous to use different types of brushes dependent on the customer's hair. Accordingly, it will be appreciated that the following examples are illustrative only. In practice, a customer hair brush kit may include different make and density of bristles, different brush shapes, different product delivery mechanisms and the like, offering maximum design flexibility.

a) The Bed of Bristles and Product Openings

Figure 1C:
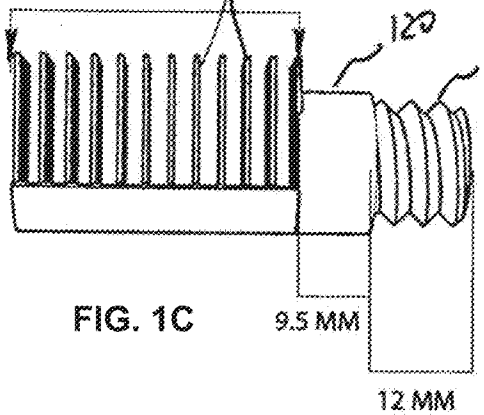
Figure 1D:
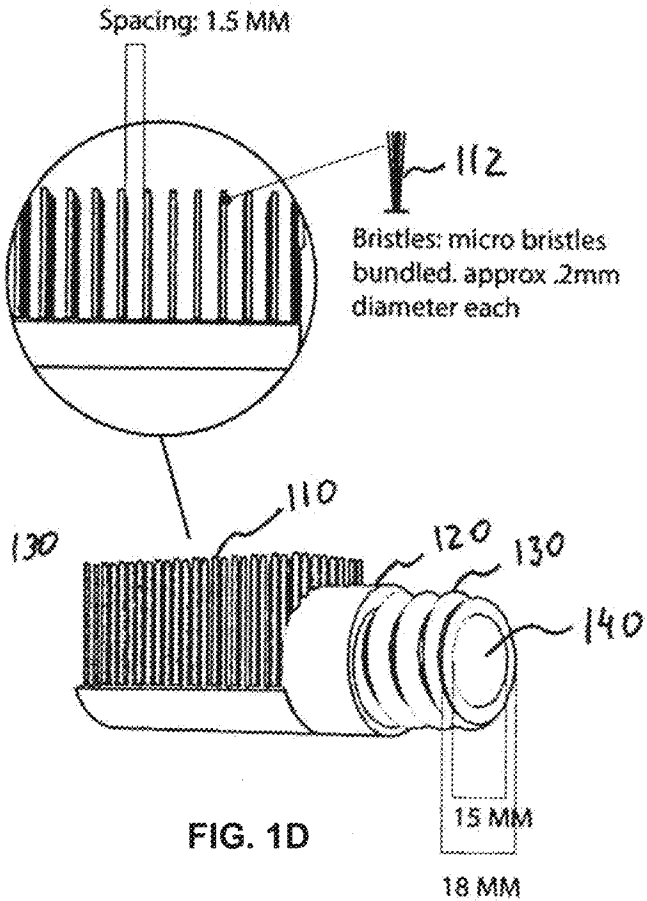

With reference to FIGS. 1B-1D, the bed of bristles 110 generally comprises an arrangement of bristle bunches 112, shown in detail in the blowout in FIG. 1D. In one example, micro bristles of approximately 0.2 mm diameter are bundled together in an arrangement of bristle bunches that are attached to a base, also referred to as a bristle bed. The arrangement illustrated in the example is a rectangular array of rows and columns similar to a regular brush, although in different examples the arrangement could be hexagonal, or any arrangement suitable for a hair brush. As will be clear below, when there is no product to dispense, the brush is intended for use as a regular hair brush. With further reference to FIGS. 1C and 1D, the bristles 112 could be made from plastic, nylon, a natural animal hair or any material that allows movement, and could be beneficially used with a hair styling or treatment product, such as a gel, while being gentle to the hair and scalp of the customer.

While the brush head 100 can be used as a normal brush, unlike such normal brushes, in accordance with the illustrated example, in addition to securing the brush bundles, the bristle bed 110 also has openings 115 through which gel (or other suitable product as described below) may be released between the bristles. In operation, the gel product, being squeezed from the product carrier, moves through the openings 115 down the shaft of the bristles onto the customer hair. Thus, on the bristle bed 110 of the brush head 100 are located in this example small holes/openings 115. In one example illustrated in FIG. 1B, openings in the bed are provided in between the bristle bunches. Only one row of openings is shown in FIG. 1B for notational clarity. These openings between the bristles enable the gel to pass through onto the bristles. In operation, the back and forth motion of the hair brush while gel comes down the bristle shaft, causes even distribution of the product onto the customer hair, which in turn helps with styling and taming of the hair. This mode of dispensing the product is akin to brushing teeth, in which the back and forth motion of the toothbrush allows for tooth paste to be distributed onto the teeth via the bristles.

The arrangement of the openings 115 can be different for different modular brush heads. For example, openings can be provided at predetermined intervals between the rows and columns of bristles, as shown in FIG. 1B. In such an example, one opening may supply treatment product to four surrounding bristle bunches. Openings may be provided on every other row and column for manufacturing simplicity. The dimensions of the openings may vary dependent on the viscosity of the particular product being used, and thus can be larger for higher viscosity products, or smaller for lower viscosity products.

As an alternative to openings at the bottom of the bed, it may be possible to use a brush head that includes a plurality of discharging slits. Also envisioned is the use of discharging fingers (not illustrated) in fluid communication with the bore. Such fingers may be formed from non-corrosive material and extend to some length shorter than the bristles. When the user causes product from the handle to flow through the head, such that the product agent is effectively caused to discharge out from the fingers in a uniform rate. Such fingers return to a normal position when the product is discharged outwardly therefrom until a new quantity of the product enters the fingers to thereby cause the fingers to bias outwardly to an extended position.

It will further be appreciated, that while the brush in FIGS. 1A-1D is shown as having a generally planar bed of bristles other shapes may be used, such as curved or circular brush head dependent on the application or manufacturing ease. Instead of a rectangular array, the brush head may have oval, or other appropriate shape. The arrangement of bristles, length of bristles, how and where they were placed on the changeable brush head, as well as the mapping of product may be subject to the different embodiments of this brush. A variety of sizes and diverse shaped changeable brush barrels is yet another aspect of the invention that may be customized.

b) The Neck

The neck portion 120 of the brush head shown in FIGS. 1A-1D generally supports the bed of bristles 110 on one side and a connector piece 130 attached to the handle on the other side. The neck, dimensioned in the illustrated example at 9.5 mm axial length, may be formed as an integral part with the bed of bristles, or as an attachment. It will be appreciated that the neck portion 120 has an axial opening providing a conduit for the product coming from the handle to the openings 115. The neck 120 of the removable brush head in general is a hollow intermediate portion between the bed of bristles and the connection piece. This portion allows the gel to flow in directly into the bed of bristles, through the holes 115 then onto the bristle shaft 112. The hollow portion, or bore 140 formed therein is axially aligned with the axis of the handle, shown below, and registered with the distal end opening for conveniently and effectively receiving the treatment product therethrough. In one example, a bore may have an interior wall that extends along an interior surface of the neck and the brush neck connector 130. The interior wall of the bore converges towards the shape of the bed of bristles, including the space designed to serve as a conduit to the openings.

c) The Brush Head Connector

Figure 2A:
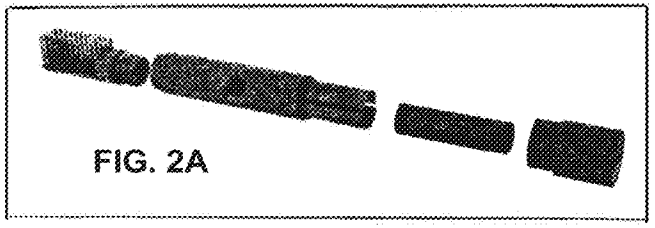

As shown in FIGS. 1B-1D, the next portion of the brush head is a connector, functioning to removably connect the bed of bristles on one end with the brush handle on the other, and to provide a conduit for the product gel traveling to the bristles. In the particular example illustrated in FIGS. 1C and 1D, the connector is a Luer style lock twist for making leak-free connection between the brush head and the section 240 of the handle, which is illustrated in FIG. 2C. Other leak-free connections may be used, as convenient in the manufacturing process.

The neck and head connector portions may be made as an integral component, in one example from a suitable plastic material. Other materials can be used dependent on design requirements.

Figure 2B:
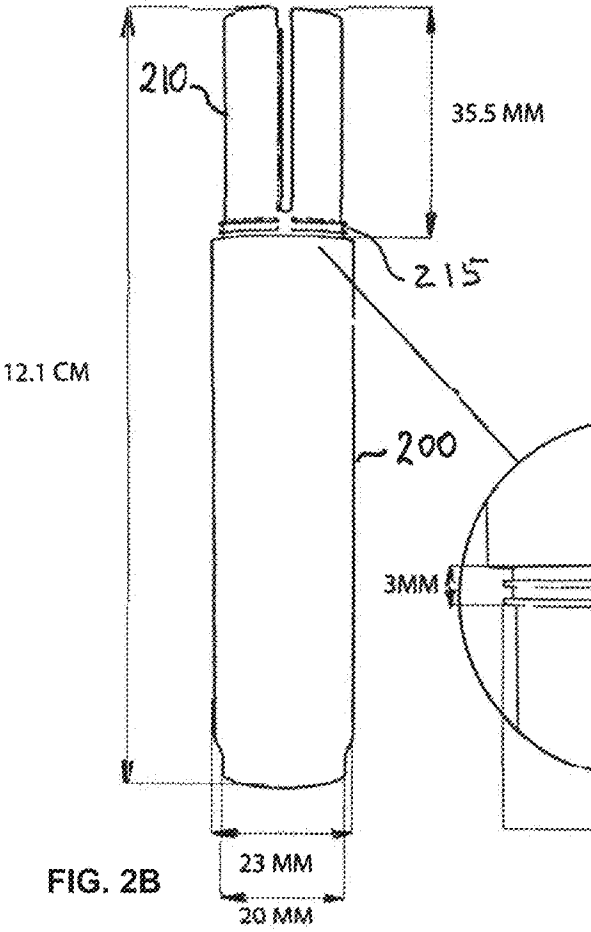
Figure 2C:
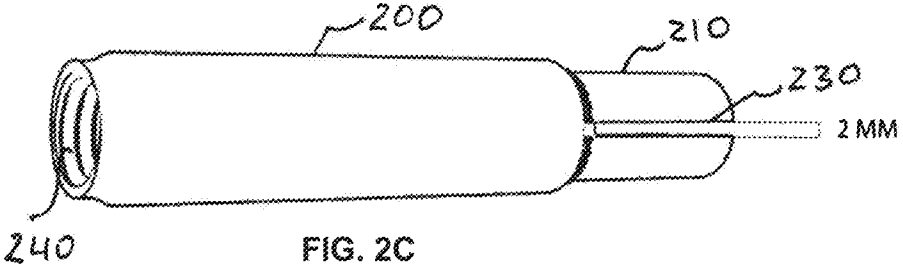
Figure 2D:
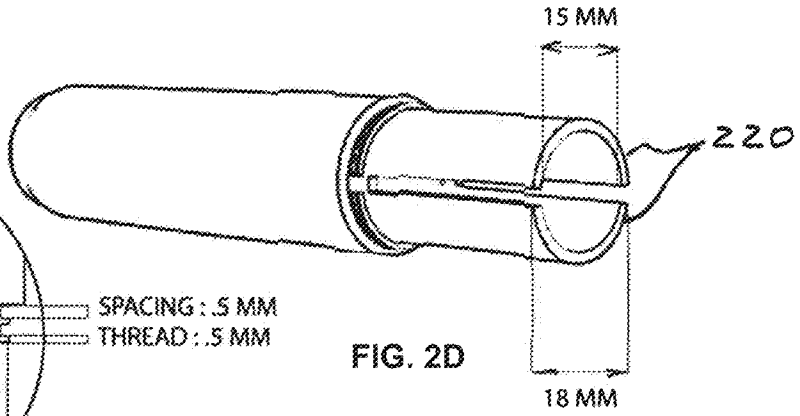

The next portion of the hair brush—its handle will now be discussed in detail with reference to the perspective views as shown in FIGS. 2B-2D.

B. The Brush Handle

Referring to FIGS. 2A-2D, the present embodiment of a disassembled hair brush is illustrated in FIG. 2A, which also shows in a detached configuration the main components of the brush (i.e., removable brush head 100, a handle or body 200, a product carrier, such as a cartridge, or product insert 300, and a base 400) in a particular example.

FIGS. 2B-2D illustrate brush handle 200, a portion of which houses the product filled carrier. One end of the handle illustrated best in FIG. 2C shows an opening 240 to the brush head. This head end portion 240 of the handle locks in the brush head in a threaded connection with brush head connector 130 shown in FIGS. 1B-1D. As noted before, this connection is preferably a leak-free type providing a product conduit between the brush head and the section 240 of the handle.

The tail end 210 of the handle 200 will receive and hold a product carrier (or insert) in place. Again, tail end 210 of the handle 200 in a preferred embodiment engages in a Luer style lock connection to the brush base shown in FIG. 4. The opening to tail gives direct entry of a suitable product carrier to lie in body of the brush handle 200. As noted, the tail end 210 attaches to base of brush shown in FIGS. 4B-4E. As shown in FIG. 2D, in this example the tail end 210 of the handle has an end 215 farthest from the brush base and nearest to a center of the handle 200, and uses a bilateral outer semi-circles 220 with visible opening 230. The bilateral side opening 230 fits to the protrusions 310 shown in the product cartridge in FIG. 3B.

With further reference to FIGS. 3B-E, opening 230 on bilateral side of tail end of body enables carrier extension 310 (FIG. 3. 310A) to slide into the body of the brush handle and be held in place. Certain dimensions are provided in FIGS. 2B-2D illustrating the relative sizes of different components, threads and spacing in a specific embodiment. As noted, the opening 240 of the handle is coaxial with the corresponding opening in the brush head, and allows gel to flow out from the handle and into the head of the brush 100.

The handle 200 could be produced from a metal, plastic, or any material that would keep a rigid shape. Plastic material would likely be preferred in some embodiments due to its durability and light weight. The handle 200 could be coated on the outside with another material that would increase comfort or be easier to grip while using. The shape, sizing, and length of the handle 200 could be adjusted to enhance the grip and comfort of the brush, as well as to provide optimal connections with the brush head on one side and the base on the other side. It will further be appreciated that the inside of the handle is dimensioned to accept a product insert or carrier, a container housing the product to be dispensed by the brush. To change the product insert, the handle 200 would be unscrewed from the base and removed to expose the inner housing tube. The product insert 300 would easily slide out and could be replaced with a new one.

C. The Product Carrier or Insert

Figure 3A:
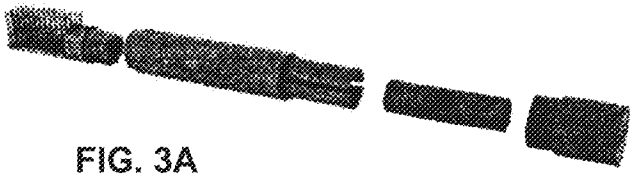
FIG. 3A, FIG. 3B, FIG. 3C, FIG. 3D, FIG. 3E illustrate an example of a replaceable product carrier containing the desired hair product in different engineering views.
Figure 3B:
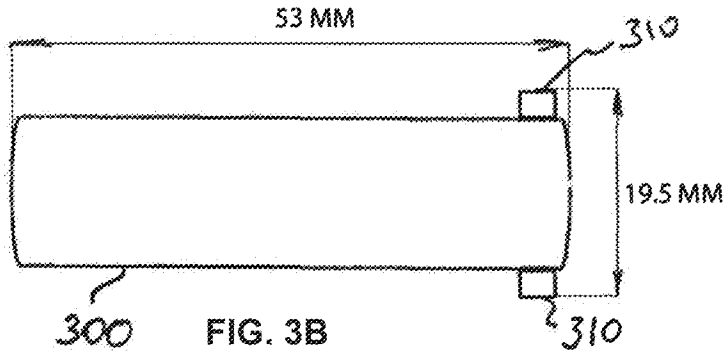
Figure 3C:
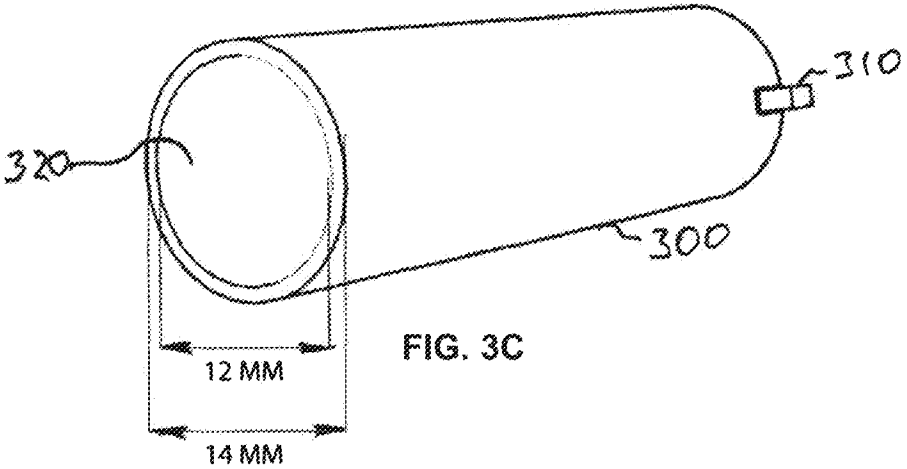
Figure 3D:
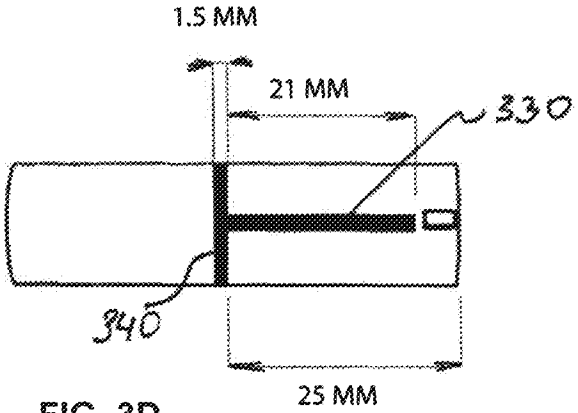
Figure 3E:
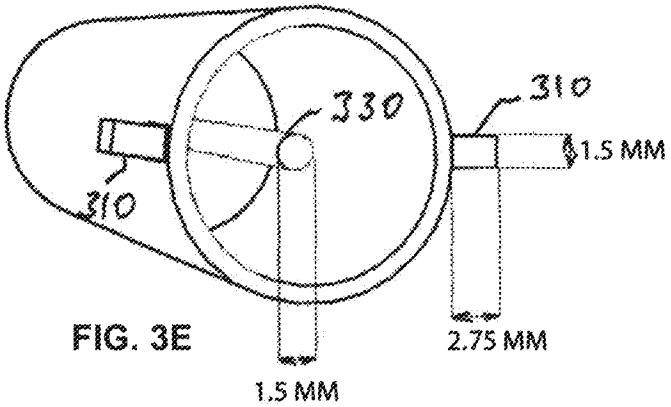

Referring to FIG. 3A, it illustrates again in a detached configuration the main components of the brush in this example. FIGS. 3B-3E illustrate an example of a replaceable product carrier or insert containing the desired hair product in different engineering views. For reference, the entire carrier that will house the gel or other suitable treatment product is designated with reference numeral 300. FIGS. 3B, 3C and 3E show carrier extension 310 that glides into the bilateral side opening 230 of the handle. The outer opening 320 at the head end of the carrier receives gel or other hair treatment product. FIG. 3D shows a partial side view of a carrier, including piston 340, which moves the product when the brush base is twisted. The operation of the moving mechanism is explained below with further reference to FIGS. 4B-4E. FIG. 3E shows a side perspective view of the tail end of the carrier, with dimensionalities selected for this particular example.

The product insert could be made from a textured fabric or paper that could tolerate hair styling materials and also be coated and retain hair styling aids or treatment for the hair or scalp. The product insert 300 could possibly contain plastic or metal components that would help with reinforcement or aid in retaining the styling or treatment products. The texture, pattern, or design configurations for the product insert would rely upon what was found to retain and disperse each product in the most fitting manner.

The product insert is inside the inner housing tube or cartridge 300. As discussed below, when the product application is desired, a twist mechanism, or slider on the handle 200 is manually moved forward forcing the product out of the cartridge and into the opening of the handle and the brush head. The outer housing tube 300 remains stationery, while the piston 340 moves inside the inner housing cylinder. The rate of engaging the twisting mechanism would depend upon the intended outcome of the style, and the quantity of the product to be dispensed onto the customer hair.

D. Example Dispenser Mechanism

Figure 4A:
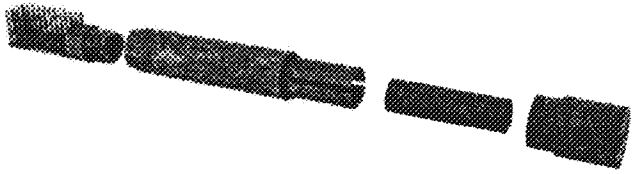
FIG. 4A, FIG. 4B, FIG. 4C, FIG. 4D, FIG. 4E illustrate a cross sectional and perspective views of the base of the brush handle, which in a specific example effects dispensing the product from a product insert, such as a cartridge, as shown in FIG. 3A, FIG. 3B, FIG. 3C, FIG. 3D, FIG. 3E, into the brush head.
Figure 4B:
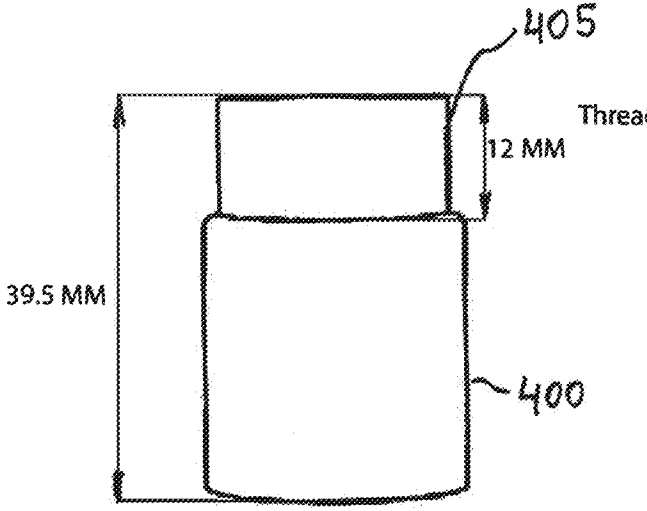
Figure 4C:
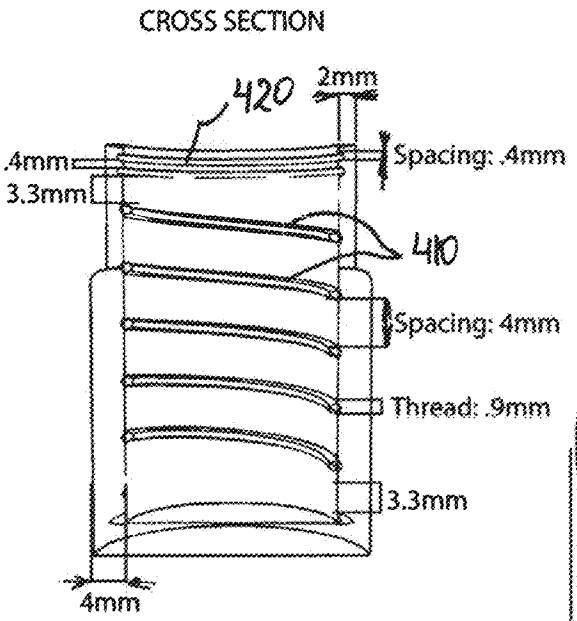
Figure 4D:
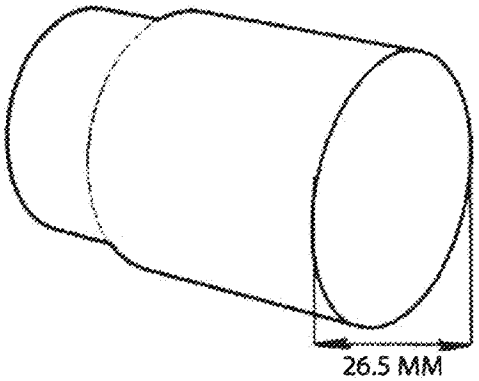
Figure 4E:
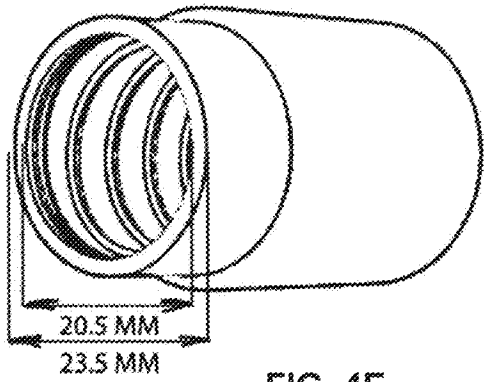

Referring to FIG. 4A, it illustrates again in a detached configuration the four main components of the brush. FIGS. 4B-4E illustrate in cross-sectional and perspective view the base 400 of the brush, which in a particular example is also used to push product from the cartridge into the brush head. The neck 405 of the base is used to provide a tight Luer style lock connection to the tail end 210 of the handle. See FIGS. 2B-2D. Proper dimensions and cross-sectional parameters are provided in FIGS. 4B-4E in a specific example. As shown, the base has thread 410 from the end part of the base to the top, which connects with the handle. Threads or grooves 410 when turned will slide a piston within the cartridge upward causing the product to move forward through the body of the brush and head where it is releases between the bristles and applied to hair. The space between thread/grooves 410 assist in the upwards movement of the piston. Internal view of the neck of base shown best in FIG. 4C illustrates the thread 420, used to provide a leak-free connection Luer style to the brush handle in FIGS. 2B-2D.

It will be appreciated that the base's internal operation in the illustrated example is similar to those used inside a chapstick, deodorant, or a lipstick. Other mechanisms for pushing a product out of a cartridge may be used in different embodiments, including as discussed below.

E. Alternative Examples

Figure 5B:
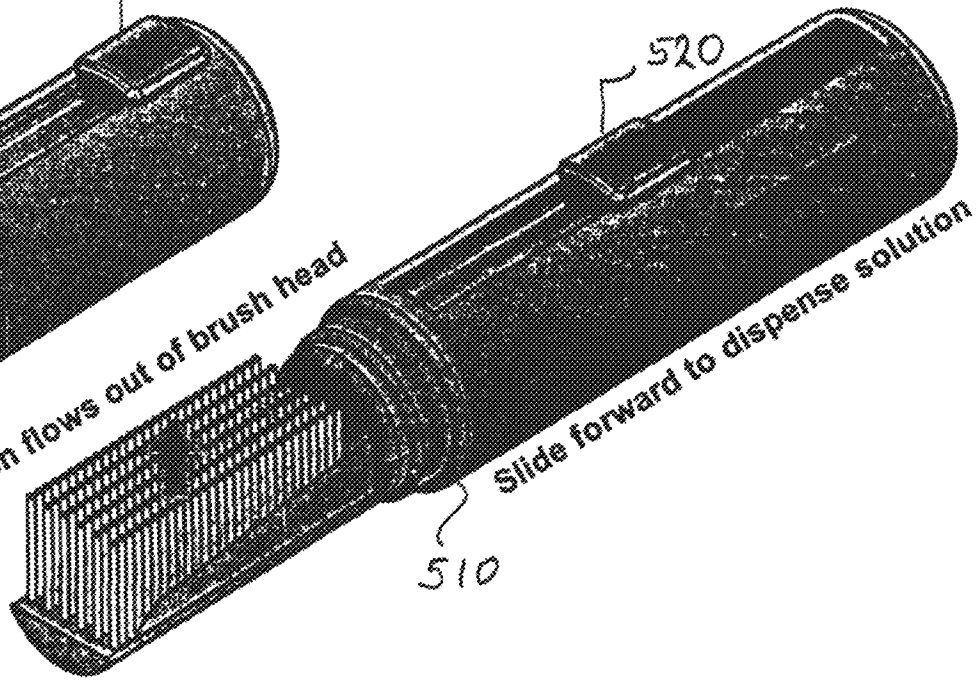
FIG. 5A, FIG. 5B are perspective views of another example of an assembled hair brush with a different product extraction mechanism.
Figure 5A:
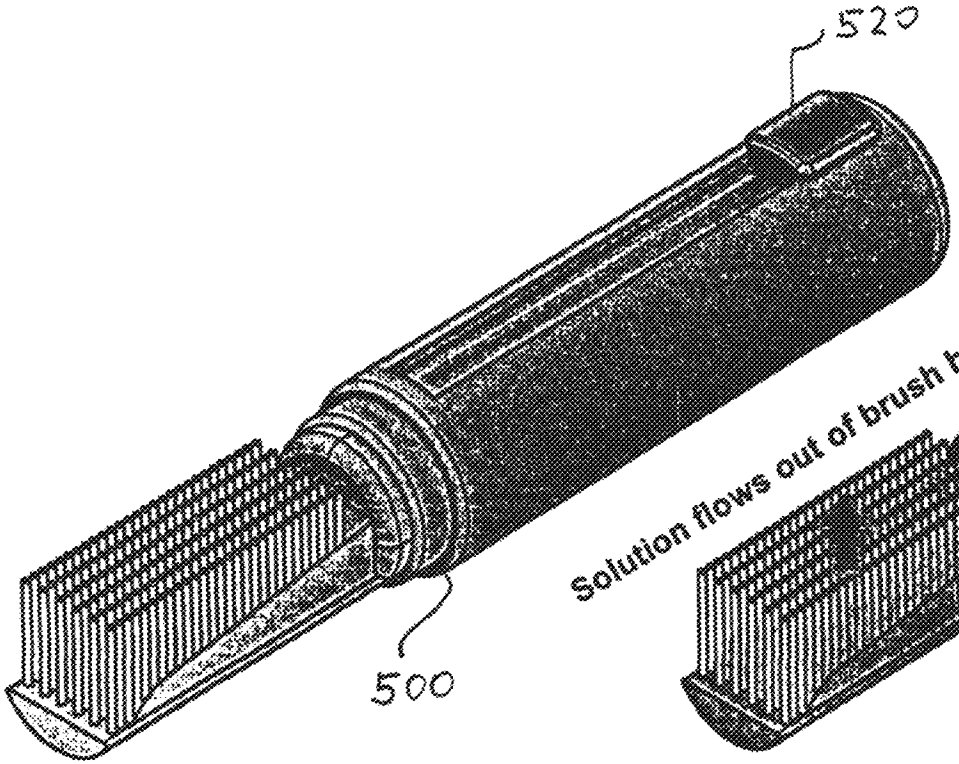
Figure 6A:
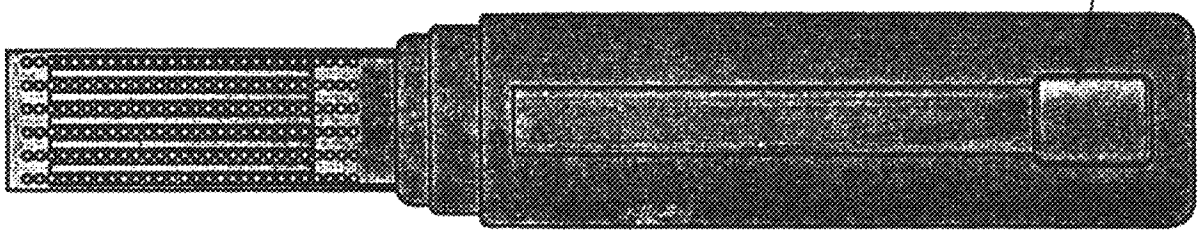
FIG. 6A, FIG. 6B, FIG. 6C, FIG. 6D, FIG. 6E illustrate a top and side views of the hair brush example shown in FIG. 5A, FIG. 5B, and certain components.
Figure 6B:
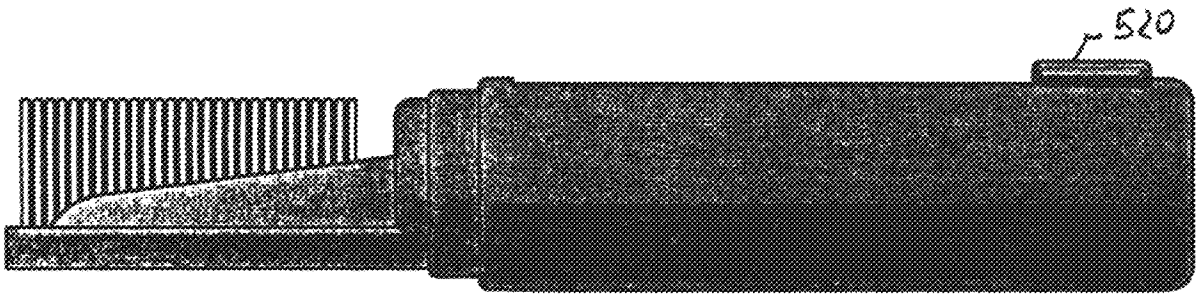
Figure 6C:
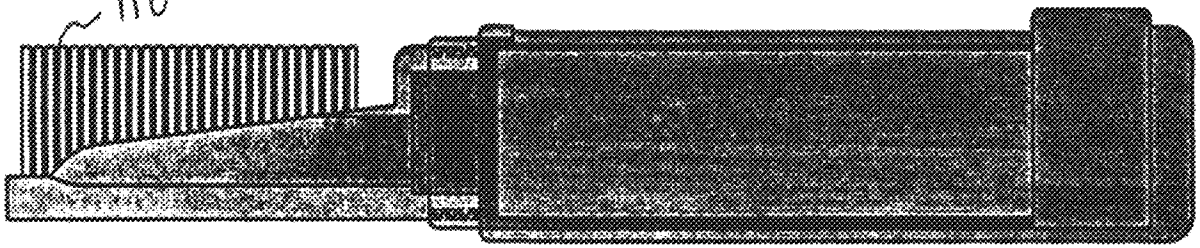
Figure 6D:
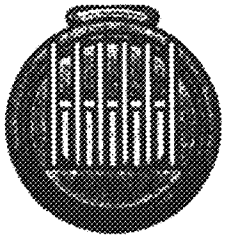
Figure 6E:
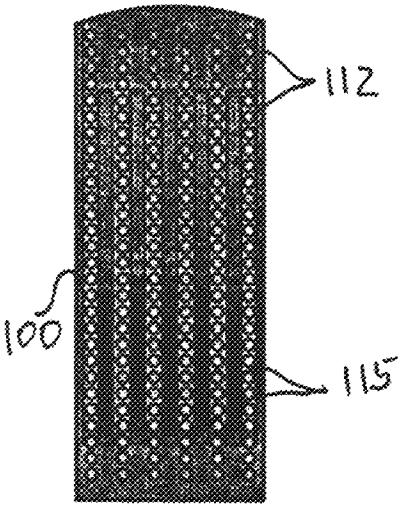

Referring next to FIGS. 5A-5B illustrated are perspective views of another example of an assembled hair brush with a different motion mechanism. In particular, the example brush has brush head similar to those considered above. In this example, however, the handle and base mechanisms are combined into one, including slider 520. Slider 520 is used to manually push a piston toward the head end of the brush. FIG. 5A illustrates the initial position of the slider 520, while FIG. 5B shows another position in which the slider is slid forward to dispense a hair treatment product.

FIGS. 6A-6E illustrate a top and side views of the hair brush example shown in FIGS. 5A-5B, and certain components in more detail. For example, FIG. 5A shows a top view of the brush, with bristle bunches as shown in FIG. 1. Also shown in FIG. 5A is a slider 520 in initial position. FIGS. 5B and 5C show side views of the same example of a hair brush. Finally, FIGS. 5D and 5E show close-up views of the brush head, with bristle bunches, and openings to supply product. In this example, openings 115 through which the solution may come out can be configured differently, for example as slits, as shown in FIG. 5E.

Figure 7A:
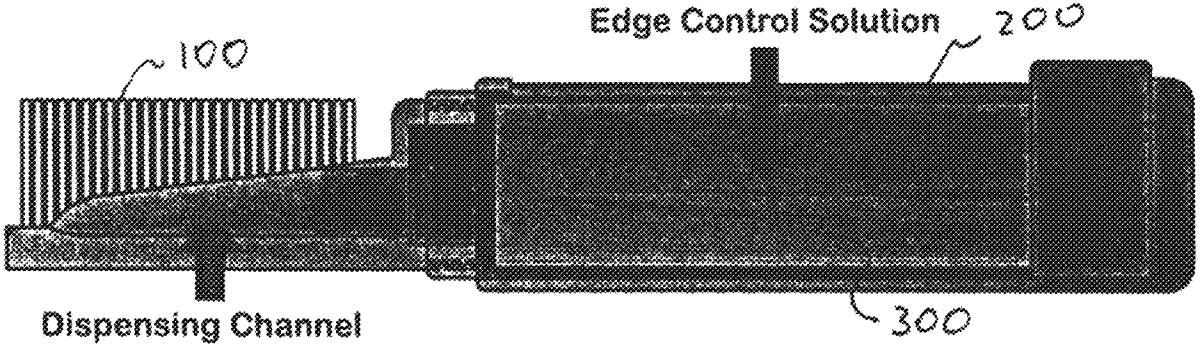
FIG. 7A, FIG. 7B, FIG. 7C are diagrams illustrating the hair brush of FIG. 5A, FIG. 5B in different stages of operation.
Figure 7B:
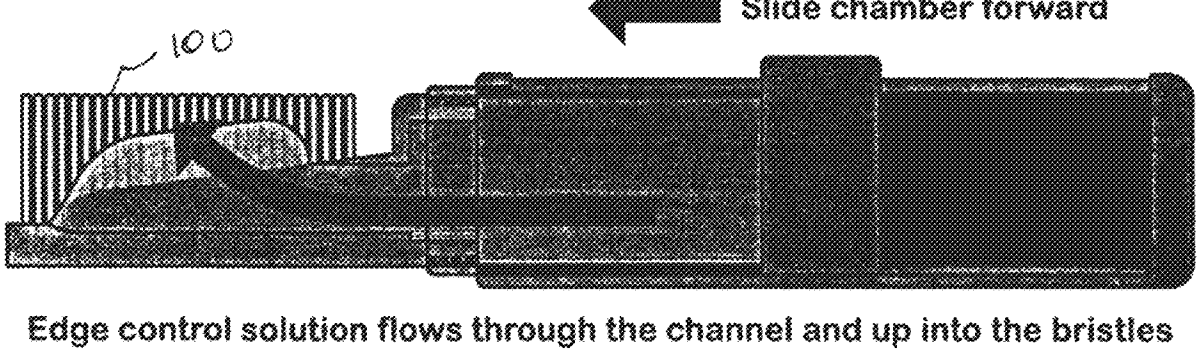
Figure 7C:
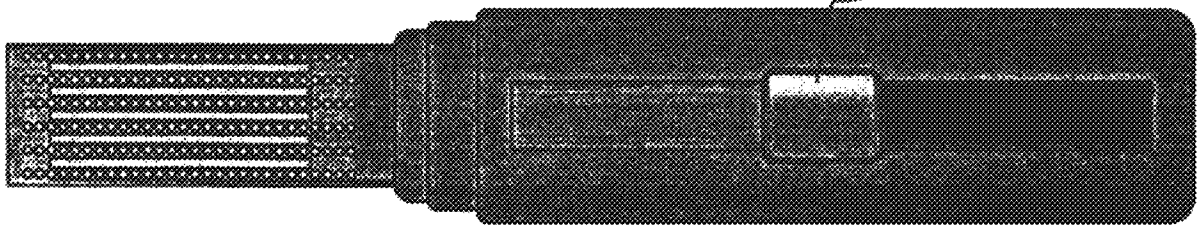

FIGS. 7A-7C are diagrams illustrating the hair brush of FIGS. 5A-5B in different stages of operation. In particular, FIG. 7A shows the brush in an initial stage, where the product is inserted and ready for use. When the slider 520 is used to slide the chamber forward, as shown in FIG. 7B product solution flows through the channel of the handle, into the corresponding channel of the brush head, and then through openings into the bristles of the brush. FIG. 7C illustrates the position of the operating slider in approximately half way through the solution.

Figures 8A, 8B, 8C:
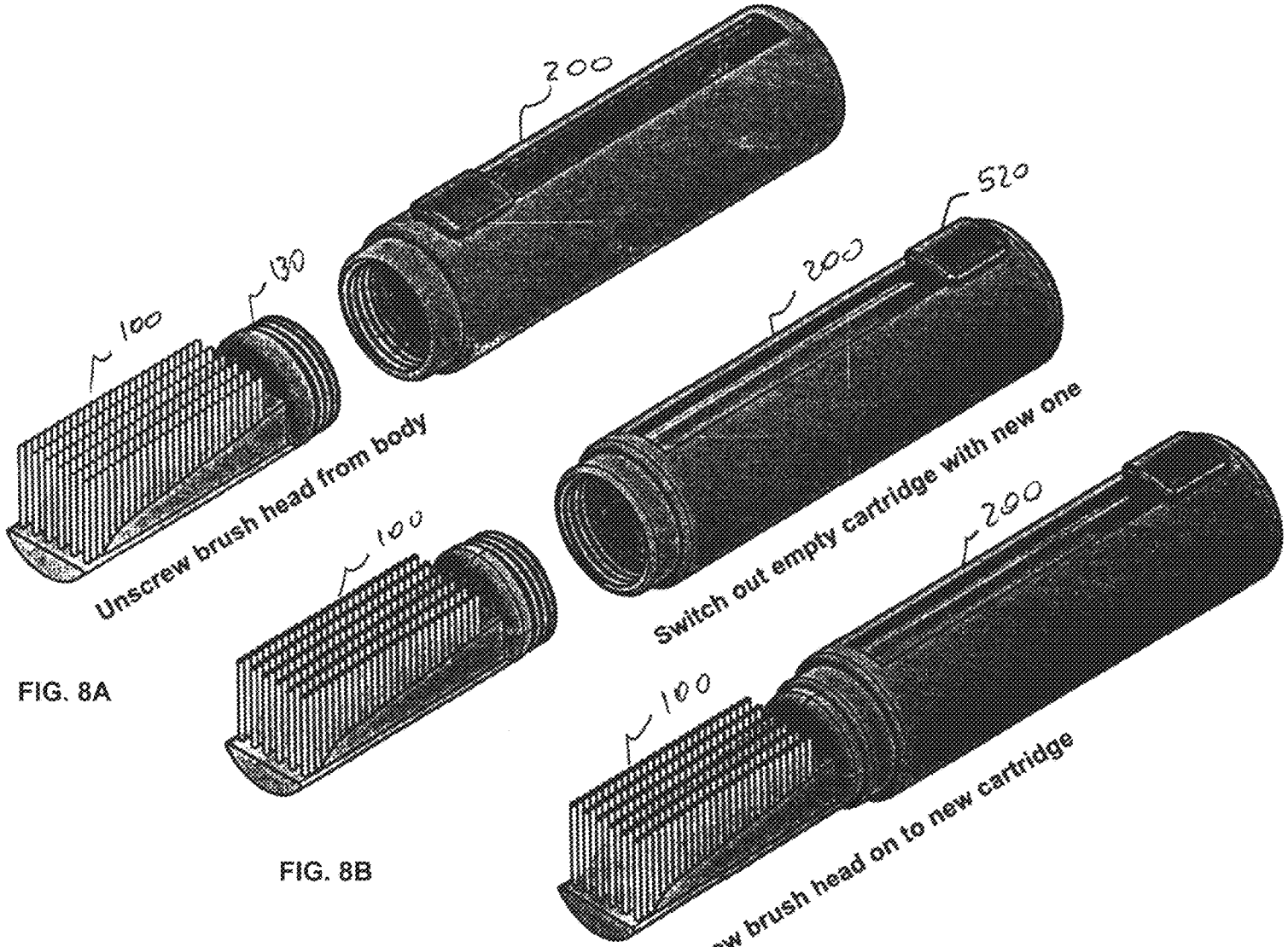
FIG. 8A, FIG. 8B, FIG. 8C are perspective views of an example of a hair brush in disassembled and assembled state.

FIGS. 8A-8C are perspective views of an example of a hair brush in disassembled and assembled state, which further illustrate replacing the cartridge with product solution, placing the replacement cartridge into the handle, and reattaching the handle to the brush head. As discussed before, similar components are labeled with the same reference numerals.

F. Operation of the Brush

The manner of using the hair brush of this invention in different examples is similar to how you would operate any other brush to aid in the shaping or styling of hair. Generally, a person would start brushing near the root area and pull the brush away from the scalp simultaneously in the same direction for the length of the hair toward the hair edge. When the desired outcome is achieved in one section, one would move to the next section and repeat the process working toward completing the desired area of the hair. Some intended results of using a brush would be straightening, smoothing, or adding volume or wave, or managing hair edges.

What sets this brush apart from other solutions is the manner in which a hair product or treatment solution is applied to the hair. In particular, the product is provided inside the cartridge 300. When product application is desired, in the examples illustrated in FIG. 1-4, the base of the handle is twisted to push the piston 340 to move the product solution to the bristles of the brush. The piston 340 includes a piston rod 330. Likewise, in the examples shown in FIG. 5-8, product application is done by moving the slider 520 forward in the direction of the bristles. Once the product cartridge is spent, the handle is removed from the brush head, the product insert is removed and replaced with a new one. In operation, the outer handle 200 remains stationery, allowing product application without much problem in the transfer of the solution to the head. Another example can be given if straightening or smoothing the hair was desired.

Referring to FIGS. 3C-3D, a predetermined quantity of hair product that in general has a fluid viscosity is housed within the chamber 320 of the carrier 300. This product is extractable through the distal opening of the chamber 320 when the user twists the base of the handle 400 and applies an exterior force axially on piston 340 against the interior of chamber 320. This design removes the need for a user to manually handle the product, which can be messy, while also allowing a person to accurately regulate the amount of product that is being dispensed onto their hair. When product replacement is needed, the piston 340 is returned to initial position by twisting the base of the brush in the opposite direction, thus enlarging the volume of the hollow chamber 320. In that initial condition, the chamber is filled with any desired product, such as a gel, conditioner, relaxing agents, shampoo, coloring agent(s), and others. The base 400 is then attached to the proximal end for maintaining the treatment product within the chamber 320. The user can then continue to evenly brush or comb their hair while periodically twisting the base of the handle 400 for conveniently and effectively excreting a desired amount of product. The brush thus provides the user with a tidy neat and efficient method of cleaning, styling and grooming their hair.

It will further be appreciated that in alternate embodiments the desired product can be provided as an insert that fits directly into the hollow chamber 320.

In another example, more precise control can be provided for the extraction of product from the chamber. In particular, with reference to FIGS. 4C and 4E and 3D, the parameters of the thread in the base can be used to compute precisely the axial motion of the piston, and hence the amount of displaced solution in the chamber relative to its total volume. In turn, this can allow a user more precise control over the amount of product being pushed to the bristles of the hair brush. The amount of displaced product solution can be calibrated against the rotational angle of the base. In such example, a reference marker can be provided on the base, which marker indicates the angle of rotation corresponding to some measure of the total solution volume. Thus, a full rotation may for instance correspond to 10% of the solution, half rotation to 5%, or the like. Instead of % solution, the angular change could be calibrated to correspond to grams of dispensed solution, or other suitable metric that can help the user more precisely control the volume of the dispensed solution. In the case of a disposable product reservoir, the base rotation can serve to determine when the product needs to be replaced. For example, smart cartridges are available, which can detect the date the solution was opened, and measure that date against an expiration date for the product. Other mechanisms for measuring the dispensed solution are available and will be readily apparent to one of ordinary skill in the art for use with the disclosed hair brush design.

In another alternative, more sophisticated design solutions are possible, where the cartridge may be divided into two (or more) sectors filled with different gel products that are only mixed when needed immediately before application (for example in hair coloring).

In alternate embodiments shown in FIG. 5-8, the hair brush of the invention can be operated to dispense product by manually moving slider 520 which drives a piston 340 into the container 300 causing it to move forward in the handle 200. The forward movement of the container 300 causes product in liquid form to be dispensed through the openings of the brush head. The forward movement of slider 520 causes liquid to be forced through liquid passageway out of the carrier 300 into the brush head 100 and ultimately out of openings 115. Other similar mechanisms can be used to manually extract the product gel into the bristles of the brush head.

On the occasion the desired product was a therapeutic or medicated scalp treatment, the hair would be sectioned and gripped near the root by the bristles 112. The base 400 or slider 520 would then be moved to the engaged position allowing the product to be moved to the root and scalp area. The combinations of products and brush techniques are only limited by the user's imagination of how the product is designed to work.

G. General Observations

The described hair brush having replaceable brush head and product inserts allows users to carry different styling products in the form of product inserts without having to carry bulky, fragile or leaky containers. The user may also use a collection of replaceable brush heads, that fit one handle. Because products are dispensed from the openings of the brush head to the bristles, and flow directly to the user's hair, products could be applied with little skin contact diminishing the concern of over-exposure for allergy sufferers. Another benefit achieved with this new system of applying products is the ability to use multiple products on the same head without overlapping and weighing down a person's hair. Furthermore, safety is achieved in keeping your hands clean and dry especially when adding the use of hot tools.

One of skill in the art will recognize that the embodiments described above are not limited to any particular size and the size of the modular hair brush will depend upon the particular application and intended components. It will be appreciated by those skilled in the art that changes could be made to the embodiments described above without departing from the broad inventive concept thereof. It is understood, therefore, that the invention disclosed herein is not limited to the particular embodiments disclosed, and is intended to cover modifications within the spirit and scope of the present invention, as provided in the appended claims.

What is claimed is:

1. A modular hair brush assembly for dispensing hair treatment product when combing hair, the modular hair brush assembly comprising:

an elongated handle to be gripped by a hand, the handle having a longitudinal axis and axially opposed first and second ends, at least the first end having an opening, the handle further having an interior hollow chamber in fluid communication with the opening at the first end of the handle, the chamber being configured to receive one or more viscous liquid hair treatment products, and the handle further comprising a pair of opening as the second end thereof;

at least one replaceable brush head comprising a neck portion, a connector, a brush surface, a plurality of bristles projecting from the brush surface, and a plurality of openings formed on the brush surface between the plurality of bristles, the brush head being removably connected to the first end of the handle, wherein the plurality of openings are in fluid communication with the hollow chamber of the handle through the opening at the first end of the handle;

a product carrier comprising two protruding carrier extensions configured to mate with the pair of openings of the handle, the product carrier being carried within the chamber and configured to store the one or more viscous liquid hair treatment products;

an extruder assembly configured to move the one or more viscous liquid hair treatment products from within the chamber through the plurality of openings on the brush surface onto the plurality of bristles of the brush head, wherein the plurality of bristles comprise bristles of approximately 0.2 mm diameter bundled together in an arrangement of bristle bunches that are provided in a rectangular array of rows and columns and attached to a rectangular bristle bed forming the brush surface of the brush head, wherein the plurality of openings are provided between the bristle bunches and provided in a rectangular array of rows and columns on the bristle bed so that there is at least one opening of the plurality of openings between each pair of the bristle bunches, wherein the neck portion of the brush head supports the bristle bed on a side of the neck portion and support the connector on an opposite side of the neck portion, and the neck portion comprises an axial opening providing a conduit for the one or more viscous liquid hair treatment products coming from the handle to the plurality of openings, wherein the connector of the brush head removably connects the bristle bed and the neck portion on a side of the connector to the handle on an opposite side of the connector, and the connector comprises a Luer connector providing a leak-free connection to the opening at the first end of the handle, and wherein the handle comprises a second opening at the second end of the handle, and the extruder assembly comprises a twist on base comprising a threaded connection for attachment to the second end of the handle, a piston moving axially within the chamber to dispense the one or more viscous liquid hair treatment products out from the first opening of the handle, and a piston rod attached to the twist on base for axially moving the piston when the twist on base is twisted.

2. The modular hair brush assembly of claim 1, further comprising at least two replaceable brush heads having projecting plurality of bristles of different density.

3. The modular hair brush assembly of claim 1, further comprising at least two replaceable brush heads having a plurality of openings with different size, allowing use of hair treatment products having different viscosity.

4. The modular hair brush assembly of claim 1, wherein the viscous liquid hair treatment product adapted for use with the hair brush assembly is suitable for styling hair edges.

5. The modular hair brush assembly of claim 1, wherein the handle is made of engineering plastic as an integral component.

* * * * *